United States Patent [19]

Messimer

[11] Patent Number: 4,741,691

[45] Date of Patent: May 3, 1988

[54] WASTE GAS BURNER

[76] Inventor: Joseph L. Messimer, P.O. Box 472, 610 W. Broadway, Winnsboro, Tex. 75494

[21] Appl. No.: 4,444

[22] Filed: Jan. 20, 1987

[51] Int. Cl.[4] ..... F23D 14/00

[52] U.S. Cl. ..... 431/202; 431/5

[58] Field of Search ..... 431/5, 13, 14, 45, 49, 431/69, 70, 202

[56] References Cited

U.S. PATENT DOCUMENTS

| | | | |
|---|---|---|---|
| 2,480,230 | 8/1949 | Elster | 431/5 X |
| 3,824,073 | 7/1974 | Straitz | 431/202 X |
| 3,833,335 | 9/1974 | Lazarre et al. | 431/202 |
| 3,954,386 | 5/1976 | Harpenslager et al. | 431/202 X |
| 4,516,932 | 5/1985 | Chaudot | 431/202 |

FOREIGN PATENT DOCUMENTS

| | | | |
|---|---|---|---|
| 1054508 | 5/1979 | Canada | 431/202 |

*Primary Examiner*—Margaret A. Focarino

*Attorney, Agent, or Firm*—John K. Donaghy, Esq.

[57] ABSTRACT

A waste gas burner is provided with a flare stack for receiving waste or hazardous gas, a chamber for receiving said gas from said flare stack, said chamber having variable openings for the passage of air, apparatus for increasing the velocity of the gas in the chamber creating a vacuum whereby ambient air is drawn into the chamber and mixed with the gas, a flare tip on said chamber for the passage of mixed gas and air and an ignitor adjacent the flare tip for igniting the gas mixture of gas and air.

13 Claims, 2 Drawing Sheets

WASTE GAS BURNER

BACKGROUND OF THE INVENTION

1. Field of the Invention

This invention pertains to gas burners of the type used to dispose of waste gas or gases, hazardous waste products and other waste carbon products.

2. Statement of the Prior Art

The prior art devices disclose flare stacks with pilot and associated thermocouple for igniting waste gas flowing through the line to the flare stack. These devices are inefficient in the manner of thoroughly burning all of the waste gas resulting in a heavy black smoke issuing from the flare stacks causing severe environmental pollution.

SUMMARY OF THE INVENTION

This invention relates to an efficient yet simple and inexpensive appartus for completely burning waste gas or gases, hazardous waste products and other waste carbon products.

It is an object of this invention to provide a flare stack for high volume, high pressure waste gas having a reducer apparatus to increase the velocity of waste gas through a mixing chamber.

It is another object of this invention to provide a flare stack for low volume low pressure waste gas having a separate pressure line to increase the velocity of waste gas through a mixing chamber.

It is still another object of this invention to provide an apparatus having the capacity to thoroughly burn both high volume, high pressure waste gas and low volume, low pressure waste gas by providing apparatus for increasing the velocity of said gas through a mixing chamber.

And still another object of this invention is to provide a flare stack having a mixing chamber having air inlets with shutters to permit varying the amount of air flow into the mixing chamber.

It is still another object of this invention to provide a waste gas burning apparatus having timer devices for controlling valving on a fuel line ignitor device for igniting fuel in an ignitor tube to provide a flame to light the pilot head in the event it is extinguished.

It is still another object of this invention to provide a thermocouple which when heated by reflame-up of the pilot head functions to send a signal to disengage a flare failure timer and an ignitor timer whereby a valve in a fuel line of the ignitor tube will close and the ignitor in the ignitor tube will disengage.

It is yet another object of this invention to provide auxiliary electric power for the ignitor system of a waste gas burner thus obviating downtime caused by failure of commercial power supplies.

These and other objects of the invention will become apparent to those skilled in the art to which the invention pertains from a reading of the following specification when taken in light of the annexed drawings.

DETAILED DESCRIPTION OF THE PREFERRED EMBODIMENT OF THE INVENTION

Figure 1:
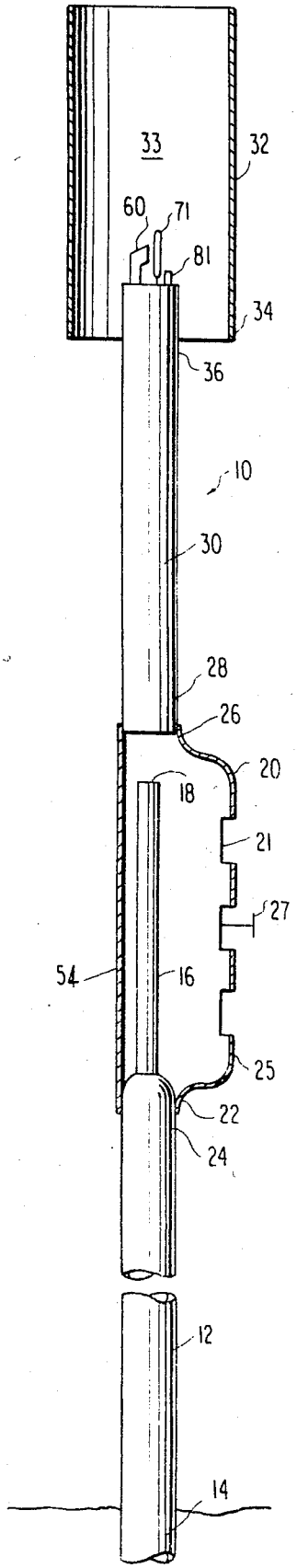
FIG. 1 is a perspective view of a flare stack for high volume, high pressure waste gas which is ignited upon exiting the apparatus.

Referring now in more detail to the drawings, FIG. 1 shows a waste gas burner 10 having a hollow flare stack 12 for receiving high volume, high pressure gas escaping from any source. A line, not shown, connects the waste gas source valves to the lower end 14 of flare stack 12. The waste gas flows upwardly in flare stack 12 and enters reducer line 16 at the upper end 24 of the flare stack wherein the velocity of the waste gas substantially increases. Line 16 is within chamber 20 and has an exit end 18 near the upper end 26 of chamber 20. The chamber 20 is attached at one end 22 to the upper end 24 of stack 12 and at its upper end 26 to the end 28 of flare tip 30. The chamber 20 has a plurality of openings 21 in rounded front wall 25 with movable shutters 27 which permit controlled amounts of air to enter the chamber 20 through the pull action of the vacuum caused by the highly accelerated waste gas issuing out of part 18 of reducer 16. The movable shutters 27 in openings 21 permit controlled amounts of fresh air to mix with the waste gas in the mixing chamber 20. The mixture of gas and air passes through flare tip 30 to wind skirt 32 attached at its lower end 34 to the upper end 36 of the flare tip 30. The mixture of gas and air is ignited by the pilot head 60 associated with thermocouple 71 and ignitor tube 81 to be more fully explained below.

Figure 2:
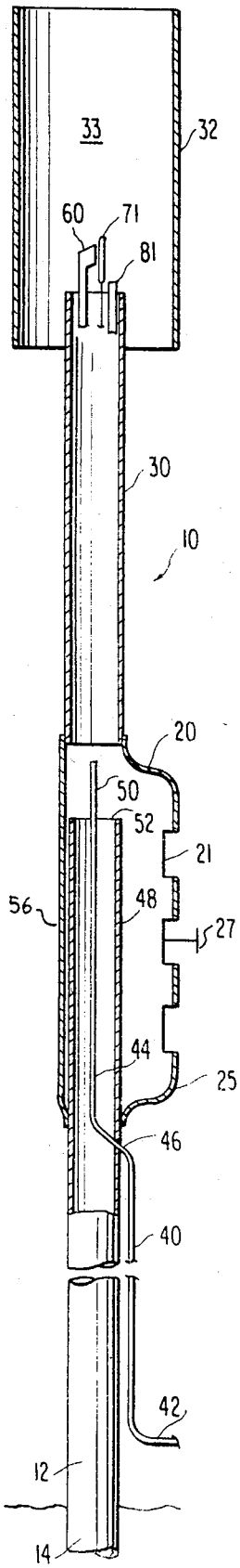
FIG. 2 is a perspective view of a low volume, low pressure waste gas burner which is ignited upon exiting the apparatus.

FIG. 2 is similar to FIG. 1 and shows another embodiment of the invention wherein flare stack 12, chamber 20 and inlet air openings 21 with movable shutters 27 are shown. Low volume, low pressure gas is received in the lower end 14 and flows upwardly through the flare stack 12. A jet line 40 is connected at one end 42 to a source of gas or air under pressure. The upper end 44 of line 40 passes through an orifice 46 in flare stack 12 and extends a distance coaxially with the end 48 of flare stack 12. The distal end 50 of jet line 40 extends from the open end 52 of stack 12. High pressure gas or air exiting end 50 will function to create a vacuum in mixing chamber 20. Jet line 40 may vary in diameter so as to facilitate regulating the amount of air drawn into the chamber 20. Further, the pressure of the gas or air in jet line 40 may be varied to vary the vacuum in chamber 20 thus further regulating the amount of air drawn into the chamber. Air will be drawn through openings 21 having movable shutters and mix with the waste gas in mixing chamber 20. The mixed gas and air passes through flare tip 30 and into wind skirt 32 forming a chamber 33 where the gas is ignited by the pilot burner means 60 and burns clean.

The advantage of the mixing chamber 20 with shuttered openings 21 will be appreciated. The gas is continuously mixed with an optimum volume of fresh air thus providing an optimum mixture of air and gas to be ignited by the pilot burner 60. A clean burn is achieved thus minimizing the amount of pollution entering the atmosphere.

Figure 3:
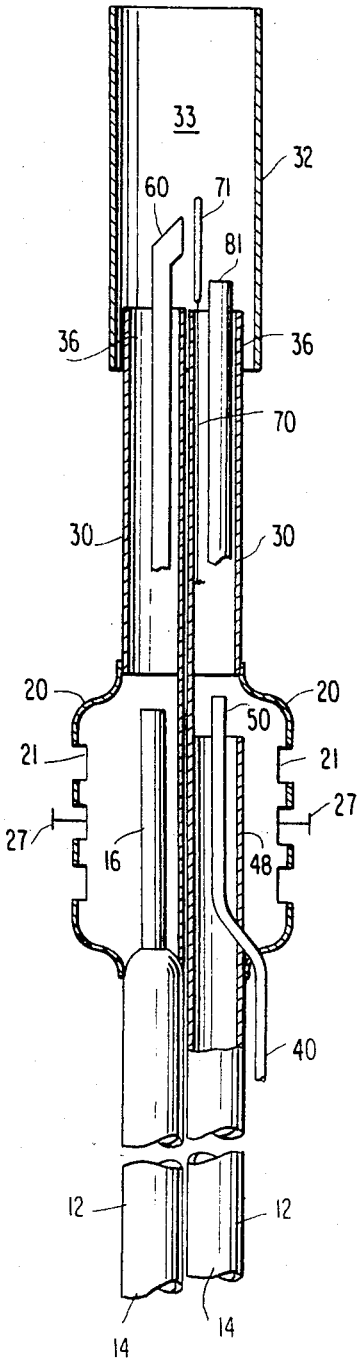
FIG. 3 is a combination high volume, high pressure/-low volume, low pressure waste gas burner which is ignited upon exiting the apparatus.

Referring now to FIG. 3, which shows yet another embodiment of the invention, it will be seen that this embodiment is the combination of apparatus of FIG. 1 and FIG. 2. The flat back 54 and the flat back 56 of chamber 20 are joined together by any suitable means to provide a waste or hazardous gas burner for burning high volume, high pressure waste gas or low volume, low pressure waste gas or the combination of two supplied from any source. A single wind skirt 32 surrounds the upper ends 36 of flare tips 30 of both units. The lower ends 14 of each unit are connected to a high volume, high pressure waste gas source and a low volume, low pressure waste gas source, respectively. These various gas sources may be oil wells, pipelines, tankers, or industrial plants for example. This combination has a single pilot burner 60, thermocouple 70 and ignitor tube 80.

Figure 4:
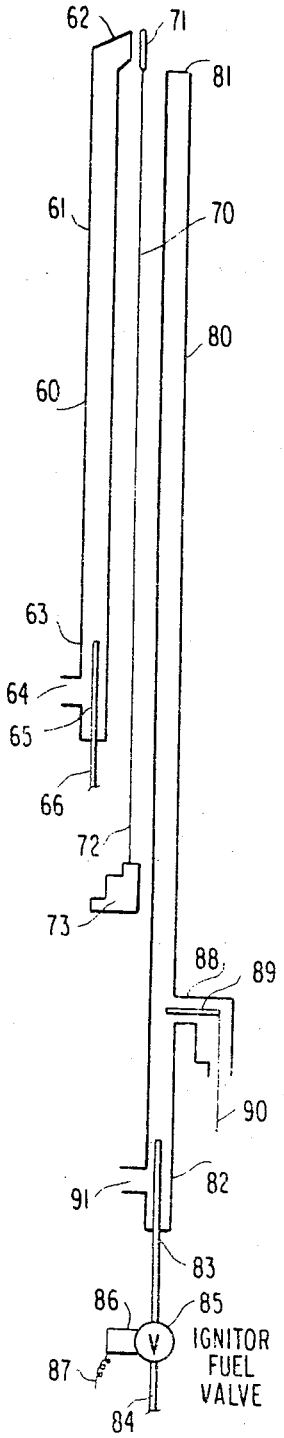
FIG. 4 is a line drawing of the pilot burner of FIG. 3.

The pilot burner 60 has an upper end 62 (FIG. 4) extending a distance coaxially with flare tip 30 and has its upper open end 62 extending beyond the end 36 of the flare tip and into the wind shirt 32. The lower end 63 has a valved air inlet 64. An end 65 of pilot fuel line 66 is suitably journaled in the end of the pilot burner line 60 as shown. The opposite end of the pilot fuel line 66 is attached to a separate source of fuel supplied by and controlled manually by the operator. The thermocouple 70 extends a distance inside flare tip 30 and has its upper end 71 extending out of the flare tip 30 adjacent to the open end 62 of the pilot burner. The opposite end 72 of the thermocouple is attached to a junction box 73. A suitable temperature controller 75 is attached to the thermocouple for monitoring the temperature of the thermocouple as is well known in the art. A source of DC power is provided to operate the temperature controller and associated components. The temperature controller 75 has connections to a flare failure timer 76 and an ignitor timer 77.

The ignitor tube 80 extends a distance coaxially in flare tip 30 and has its open end 81 extending out of end 36 of flare tip 30. The open end 81 is juxtaposed near the open end 62 of the pilot burner. The opposite end 82 of the ignitor tube 80 receives an end 83 of a fuel line 84, the opposite end of which is attached to a source of fuel. A valve 85 in the fuel line 84 is operated by a solenoid 86 attached to timer 77 by electrical wires 87 and 78. The burner tube 80 is fitted with a spark plug junction box 88 having a spark plug 89 therein. The spark plug is connected to a source of high voltage through an ignitor timer 77 by line 90 and 92.

Figure 5:
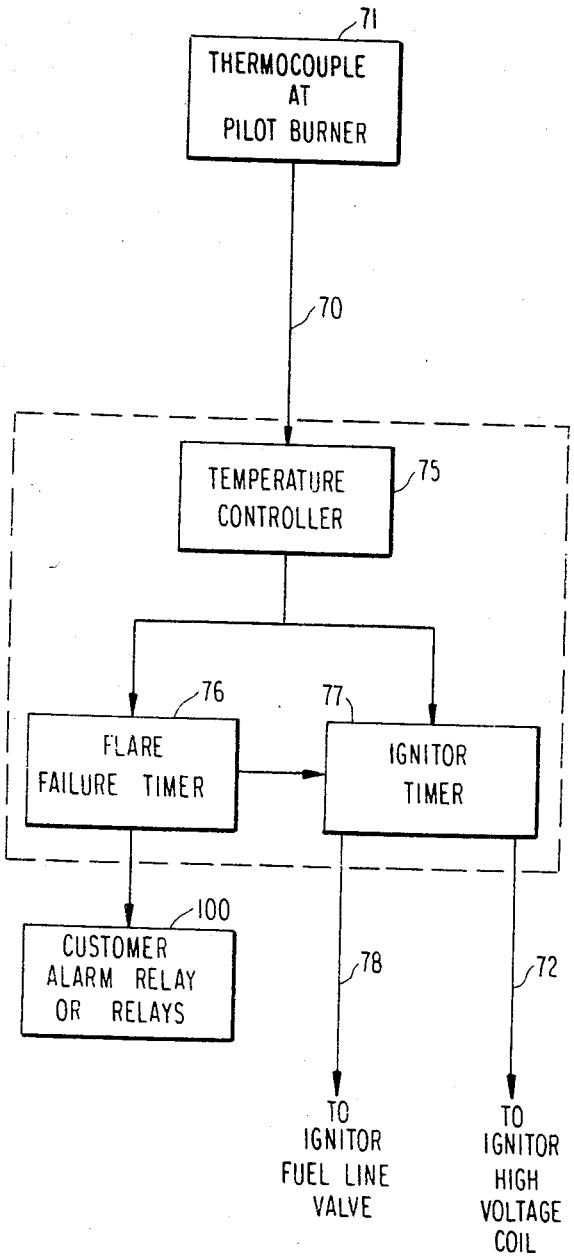
FIG. 5 is block diagram of the controls used in association with the thermocouple for activating an ignitor timer and a flare failure timer.

Referring now to FIG. 5, there is shown in block diagram the operation of the system in the event the pilot flame is extinguished for some reason whereby gas continues to flow out open end 62 of the pilot burner 60. With no flame on the thermocouple end 71 near the pilot burner end 62, the thermocouple end 71 begins to cool which cooling temperature is detected at opposite end 72 which end is attached through junction box 73 to the temperature controller 75. The temperature controller senses the change of temperature and sends a signal to the flare failure timer 76 and the ignitor timer 77 simultaenously. The ignitor times is a dual timer with dual settings. The first setting has a line 78 to solenoid 86 to open and close the valve 85 in ignitor fuel line 84. When the valve 85 is opened fuel passes into the burner tube 80 and at the same time draws air through orifice 91 which mixes with the gas. The mixture of gas and air passes over the spark plug inside junction box 88 and up the ignitor tube 80 exiting end 81 for a predetermined time depending on the timer (optimally 15 to 30 seconds). The ignitor times second setting has a line 92 connecting a source of power to the spark plug through line 90. The ignitor timer second setting starts at the end of the ignitor timer first setting. The ending of the second timer setting will activate the power to the spark plug 89. A high voltage spark will occur and ignite the fuel and air mixture which will cause a flame to occur at open end 81 of burner tube 80. This flame will ignite the gas issuing from the pilot open end 62.

A flame on the head 62 of the pilot burner 60 will heat the thermocouple 71. The elevated temperature will be detected by the temperature controller which will then operate to disengage the flare failure times 76 and the ignitor timer 77. This action will remove electric power from the solenoid 86 whereby the valve 85 will close thus shutting off fuel line 84. At the same time, electric power will be disconnected from the power line 90 attached to the spark plug 89. In the event that the ignitor tube 80 fails to deliver a flame to the pilot head 62 after a predetermined time, the flare failure timer will function to disconnect the ignitor timer and activate the customer alarm relay 100. The alarm relay 100 will activate an alarm thereby alerting that there is a low temperature on the thermocouple or no flame on the pilot burner whereby appropriate emergency action may be taken. The relay 100 may be connected to a shut down system thus preventing waste gas or hazardous gas from entering the flare stack.

What I claim is:

1. A waste gas burner comprising:

a first flare stack for receiving high volume, high pressure waste gas;

a chamber on said first flare stack for receiving said high volume, high pressure waste gas from said first flare stack, said chamber having ambient air inlet means;

means in said chamber for creating a vacuum whereby ambient air is drawn into said chamber and mixed with said high volume, high pressure waste gas;

a second flare stack for receiving low volume, low pressure waste gas;

a chamber on said second flare stack for receiving said low volume, low pressure waste gas from said second flare stack, said chamber having ambient air inlet means;

means in said chamber for creating a vacuum whereby ambient air is drawn into said chamber and mixed with said low volume, low pressure waste gas;

flare tips on said chambers for the passage of said mixed gas and air, said flare tips having outlet ends positioned adjacent each other;

a wind skirt positioned over the outlet ends of the flare tips to receive the mixed gas and air therefrom; and ignitor means disposed within the space bounded by the wind skirt and adjacent said flare tips for igniting said mixed waste gas and air.

2. A waste gas burner according to claim 1, wherein:

said means in said chamber for receiving said high volume, high pressure waste gas for creating a vacuum comprises restriction means attached to said flare stack whereby the velocity of said gas is increased and enters said chamber creating a vacuum whereby ambient air is drawn into said chamber and mixed with said gas.

3. A waste gas burner according to claim 1, wherein:
said means in said chamber for receiving low volume, low pressure gas for creating a vacuum comprising a separate source of pressurized gas or air entering said chamber and accelerating said low volume, low pressure gas creating a vacuum whereby ambient air is drawn into said second and mixed with said gas.

4. A waste gas burner according to claim 1, and:
said chambers for receiving said high volume, high pressure gas and said chamber for receiving said low volume, low pressure gas having flat back walls, front rounded walls with openings, bottom open ends attached to said flare stacks and upper open ends attached to said flare tips whereby said high volume, high pressure gas and said low volume, low pressure gas pass through said flare tips to said igniting means.

5. A waste gas burner accoridng to claim 4, and:
said openings have movable shutters therein for varying the amount of ambient air entering said chamber.

6. A waste gas burner accoridng to claim 1, wherein:
said ignitor means comprises a pilot burner having a flame thereon for igniting said mixed gas and air.

7. A waste gas burner according to claim 6, and:
a thermocouple adjacent said pilot burner for detecting the absence of a flame thereon and sending a signal to timer means for activating auxiliary flame producing means for reflaming the pilot burner after a predetermined time and for activating an alarm after a time greater than the predetermined time in the event that the auxiliary flame producing means fails.

8. A waste gas burner comprising:
a flare stack for receiving waste or hazardous gas and having an open end;
a chamber on said flare stack for receiving said gas from said flare stack;
said chamber having means for the passage of ambient air;
jet line means attached at one end to a source of gas under pressure and entering said flare stack at the opposite end of said jet line and extending co-axially therewith a distance and entering into said chamber at a point above said open end of said flare stack said gas under pressure in said jet line creating a vacuum in said chamber drawing ambient air into said chamber through said means for the passage of ambient air whereby said ambient air is mixed with said gas exiting the flare stack;
a flare tip on said chamber for the passage of said mixed gas and air; and
ignitor means adjacent to said flare tip for igniting said mixed gas and air.

9. A waste gas burner as claimed in claim 8, wherein:
said means for the passage of ambient air comprises openings with movable shutters to vary the amount of air passing through the openings.

10. A waste gas burner as claimed in claim 8, wherein:
said ignitor means comprises a pilot burner having a flame thereon; and
a thermocouple is adjacent said pilot burner for detecting the absence of a flame thereon and sending a signal to timer means for activating auxiliary flame producing means for reflaming the pilot burner after a predetermined time and for activating an alarm after a time greater than the predetermined time in the event that the auxiliary flame producing means fails.

11. A waste gas burner as claimed in claim 8, wherein:
said chamber has a flat back wall, a rounded front wall, an open bottom end attached to said flare stack and an open upper end attached to said flare tip, and said means for the passage of ambient air comprises openings in the front wall, said flat back wall enabling two of said chambers to be placed in back-to-back close proximity with one another when desired.

12. A waste gas burner comprising:
a flare stack for receiving waste or hazardous gas under prssure;
a chamber attached at one end to an upper end of said flare stack and attached at its other end to a flare tip, said chamber for receiving said gas from said flare stack;
said chamber having a closed back wall and a front wall having a plurality of openings for the passage of ambient air;
moveable shutters in said openings permit controlled amounts of ambient air to enter said chamber;
a reducer tube having one end extending from said flare stack and extending within said chamber, whereby the velocity of gas entering said chamber from the reducer tube creates a vacuum and draws ambient air into said chamber through said openings and is mixed with said waste or hazardous gas;
a flare tip on said chamber for the passaage of said mixed gas and air; and
ignitor means adjacent said flare tip for igniting said mixed gas and air.

13. A waste gas burner as claimed in claim 12, wherein:
said ignitor means comprises a pilot burner having a flame thereon; and
a thermocouple is adjacent said pilot burner for detecting the absence of a flame thereon and sending a signal to timer means for activating auxiliary flame producing means for reflaming the pilot burner after a predetermined time and for activating an alarm after a time greater than the predetermined time in the event that the auxiliary flame producing means fails.

* * * * *